US005180353A

United States Patent [19]

Snyderman

[11] Patent Number: 5,180,353

[45] Date of Patent: Jan. 19, 1993

[54] HYDRAULIC RESISTIVE APPARATUS FOR EXERCISE EQUIPMENT

[75] Inventor: Fredric Snyderman, Sharon, Mass.

[73] Assignee: CSA, Inc., South Easton, Mass.

[21] Appl. No.: 651,807

[22] Filed: Feb. 7, 1991

[51] Int. Cl.[5] ..... A63B 21/008

[52] U.S. Cl. ..... 482/111; 482/53

[58] Field of Search ..... 272/70, 69, 72, 130, 272/93; 165/183, 901; 92/144, 169.1; 482/111, 112, 53, 52

[56] References Cited

U.S. PATENT DOCUMENTS

| | | | |
|---|---|---|---|
| 2,161,417 | 6/1939 | Holmes | 165/901 |
| 3,002,729 | 10/1961 | Welsh | 165/183 |
| 4,813,667 | 3/1989 | Watterson | 272/70 |

FOREIGN PATENT DOCUMENTS

| | | | |
|---|---|---|---|
| 0370173 | 1/1907 | France | 257/261 |

*Primary Examiner*—Stephen R. Crow
*Attorney, Agent, or Firm*—Herbert L. Bello

[57] ABSTRACT

A hydraulic resistive apparatus that is used in exercise equipment includes a resistive device and a heat dissipating device. The resistive device includes a cylinder and a piston that are movable relative to one another. A working fluid is contained within the cylinder. The heat dissipating device is securely engaged to the outside of the cylinder and includes a tubular body having a plurality of cooling fins extending from its external surface. As heat is generated by the relative movement of the cylinder and piston, it is conducted to the heat dissipating device and then radiated into the surrounding environment. The body of the heat dissipating device includes a longitudinal slit that permits temporary opening of the body so as to permit it to be slid onto the cylinder and, when released, results in full surface-to-surface contact between the heat dissipating device and cylinder.

15 Claims, 2 Drawing Sheets

HYDRAULIC RESISTIVE APPARATUS FOR EXERCISE EQUIPMENT

BACKGROUND OF THE INVENTION

1. Field of the Invention

The present invention relates to hydraulic apparatuses that are used to provide a resistive force and, more particularly, is directed towards hydraulic resistive apparatuses that are used in exercise equipment and cooling devices for dissipating heat generated by such apparatuses.

2. Description of the Prior Art

Exercise devices are often used to simulate aerobic exercises such as rowing, cross-country skiing, and stair climbing. The use of aerobic exercise devices is preferred as they can provide a continuous, steady work-out at a convenient location, for example, at home or an exercise facility. In order to more closely simulate a particular activity, these exercise devices are equipped with hydraulic and/or mechanical devices that provide a resistive force to arm and leg movement. A typical stair-stepping type exercise device employing a hydraulic device for providing the desired resistive force is marketed by CSA, Inc. under the trademark ALPINE CLIMBER.

The use of hydraulic systems for providing the resistive force utilized in exercising equipment is preferred since these systems have relatively few moving parts and are reliable. In general, a hydraulic system includes a cylinder and a piston that is reciprocally mounted in the cylinder. One of either the piston or the cylinder is mounted to a stationary member and the other one of the piston and cylinder is attached to a movable member. The desired hydraulic resistive force is produced by the restricted flow of a working fluid, for example, a hydraulic fluid, that is contained within the cylinder. Hydraulic resistive systems suffer from the disadvantage and limitation that as the hydraulic system is operated during a typical work-out it progressively becomes hotter and less resistive to compressive forces. The heat produced by the compression and restricted flow of the hydraulic fluid, and the friction between the cylinder and piston, causes a decrease in the viscosity of the hydraulic fluid within the cylinder. As the hydraulic fluid becomes less viscous, less force is necessary to move the piston and compress the hydraulic fluid. As less resistive force is provided by the hydraulic system the effectiveness of the exercise device decreases.

A need has arisen for a hydraulic resistive device that can be easily mounted on, and used in, exercise equipment and is capable of providing a substantially constant resistive force during an extended period of operation.

SUMMARY OF THE INVENTION

It is an object of the present invention to provide a hydraulic resistive apparatus that does not suffer from the foregoing disadvantages and limitations.

It is a further object of the present invention to provide a continuously cooled hydraulic resistive apparatus that is economical to manufacture and that provides a substantially constant resistive force as it is operated.

It is a yet another object of the present invention to provide an exercise apparatus utilizing a continuously cooled hydraulic resistive device that provides a substantially constant resistive force as it is operated.

The hydraulic resistive apparatus of the present invention is characterized by a heat dissipating resistive apparatus and a heat dissipating device. The resistive device includes a cylinder that contains a working fluid and is movable relative to a piston. The working fluid is compressed and flows within the cylinder when the resistive apparatus is operated. Heat is generated during operation of the resistive apparatus as a result of the compression and flowing of the working fluid and the friction between the cylinder and piston.

The heat dissipating device is securely engaged to an outer surface of the cylinder in full surface-to-surface contact. The heat dissipating device includes a body section and a plurality of fins that extend radially from an outer surface of the body section. More particularly, the body section is an elongated tubular member having an inner diameter which is sized to snugly engage the outer diameter of the cylinder of the resistive device. An opening or slit is cut into the body section along a line substantially parallel to its longitudinal axis. The slit permits the body section to be held open temporarily while the heat dissipating device is slid onto the cylinder. When released, the slit returns to its original size so that there is substantially full surface-to-surface contact between the outer surface of the cylinder and an inner surface of the body section. Preferably, the heat dissipating device is composed of a flexible, heat-conductive material which is flexible enough to permit flexing of the heat dissipating device so that it can be slipped onto the cylinder, yet is rigid enough to insure the desired surface-to-surface contact as well as prevent any unwanted movement of the heat dissipating device relative to the cylinder.

The hydraulic resistive apparatus can be utilized in an exercise apparatus. Typically, the resistive device is mounted such that one end of the resistive apparatus, either the cylinder or piston, is connected to a substantially stationary member and the other end of the resistive apparatus is connected to a movable member. As the movable member is moved during operation of the exercise apparatus, the cylinder and piston are moved relative to each other, thus causing the generation of heat as described above. The heat produced is communicated to the heat dissipating device via conduction and radiated into the surrounding atmosphere, thus continuously cooling the resistive device.

Other general and specific objects of the invention will in part be obvious and will in part appear hereinafter.

The invention accordingly comprises the steps and apparatus embodying features of construction, combinations of elements and arrangements of parts adapted to effect such steps, as exemplified in the following detailed disclosure, and the scope of the invention is indicated in the claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
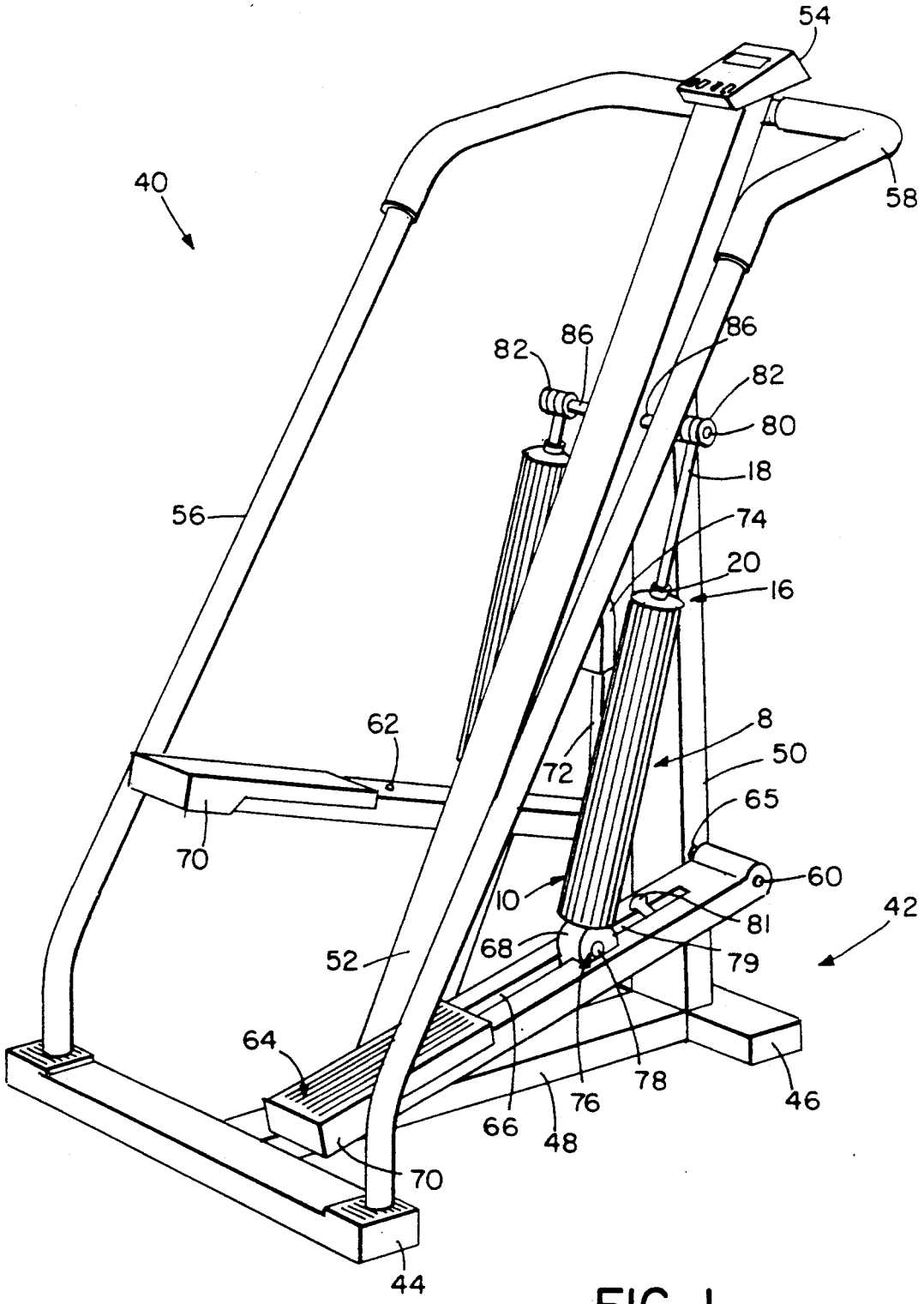
FIG. 1 is a perspective view of an exercise apparatus incorporating the hydraulic resistive apparatus of the present invention.
Figure 2:
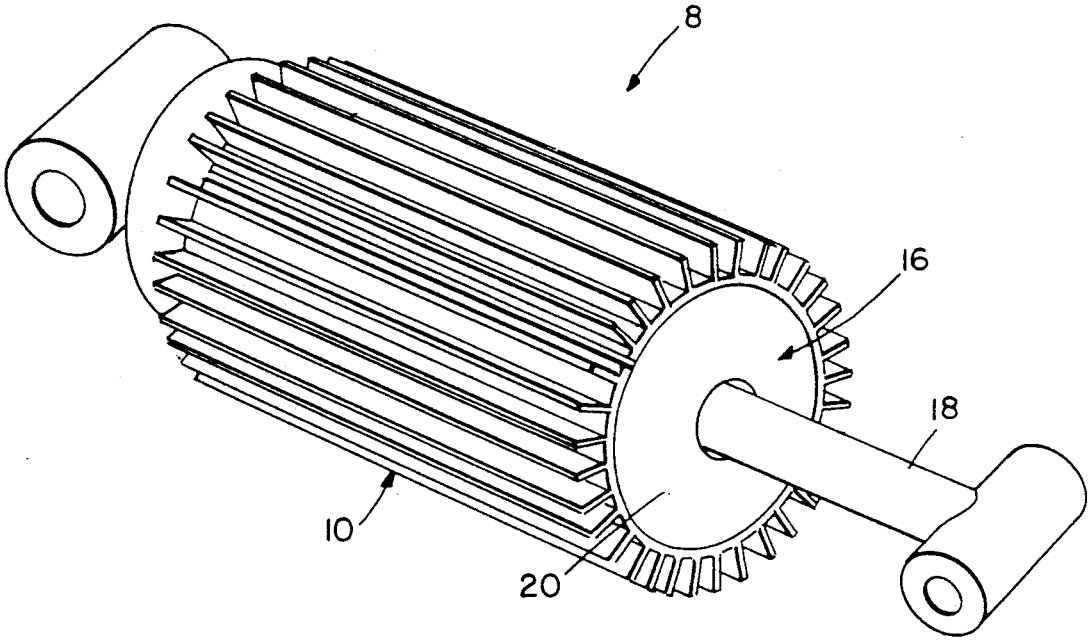
FIG. 2 is a perspective view of the heat dissipating hydraulic resistive apparatus of FIG. 1.

Referring now to the drawings, particularly FIGS. 1 and 2, wherein like reference numerals refer to like parts, there is illustrated a hydraulic resistive apparatus 8. The hydraulic resistive apparatus 8 includes a heat dissipating device 10 securely engaged to a hydraulic resistive device 16. The heat dissipating device 10 includes a body section 12 having a plurality radially extending cooling fins 14. The hydraulic resistive apparatus 8 can be mounted in an exercise apparatus 40, as shown in FIG. 1.

The hydraulic resistive device 16 includes a piston 18 and cylinder 20, the piston 18 being constrained for reciprocal movement. As hereinafter described in connection with FIG. 1, the piston 18 is mounted to a fixed member and the cylinder 20 is mounted to a movable member, the cylinder 20 is movable relative to the piston 18. The cylinder 20 contains a working fluid, for example, hydraulic fluid, that flows within it when the resistive device 16 is operated, i.e., the cylinder 20 is moved relative to the piston 18. The piston 18 can include one-way valves (not shown) that produce increased resistance during either inward or outward movement of the piston 18 relative to the cylinder 20. Heat is generated during operation of the resistive device 16 as a result of the flowing of the working fluid and the friction between the components of the cylinder 20 and piston 18. The heat dissipating device 10 is securely engaged to the outer surface of the cylinder 20 to dissipate the heat generated by the hydraulic resistive device 16.

Figure 3:
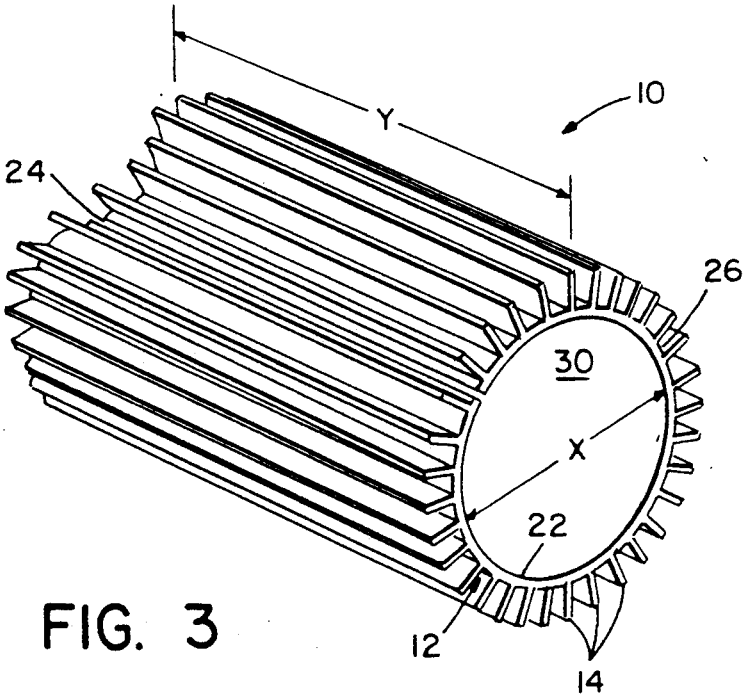
FIG. 3 is a perspective view of a heat dissipating device for the hydraulic resistive apparatus of FIG. 1.

As best shown in FIG. 3, the body section 12 of the heat dissipating device 10 includes an axially extending tubular section 22 having an opening or slit 24. The tubular section 22 has an inner diameter "X" and length "Y" that are substantially identical to an outer diameter and length of the cylinder 20. In the presently preferred embodiment of the invention, the tubular section 22 has an inner diameter "X" of approximately one and a half (1.5) inches and a length "Y" of about fourteen (14) inches. Preferably, the tubular section 22 is about 0.0625 inches thick. Of course, the diameter "X" and length "Y" can be altered as required by the design of the cylinder 20 selected. The slit 24 is generally parallel to a longitudinal axis of the tubular section 22 and permits alteration of the inner diameter "X" of the tubular section 22 so as to allow the heat dissipating device 10 to be temporarily spread apart so that it can be slid onto the cylinder 20. The opening 24 is about 0.125 to 0.375 inches wide. The body section 12 has an outer surface 26 from which the cooling fins 14, described below, extend radially.

A plurality of cooling fins 14 extend radially from the tubular section 22 of the body section 12. The cooling fins 14 extend axially along substantially the entire length of the tubular section 22. The height and thickness of the fins 14 are selected to maximize the cooling surface area of the heat dissipating device 10 while attaining maximum manufacturing and cost efficiency. In the presently preferred embodiment of the invention, the cooling fins 14 are about 0.25 inches tall and are spaced on 0.125 inch centers. Given these dimensions and the preferred size of the tubular section 22, it is possible to position thirty-three (33) cooling fins 14 around the outer surface 26 of the tubular section 22.

The heat dissipating device 10 is composed of a heat-conductive material having sufficient flexibility to permit flexing when the heat dissipating device 10 is slipped onto the cylinder 20. The heat-conductive material must also be rigid enough to securely hold the heat dissipating device 10 to the cylinder 20 and insure that substantially all of the inner surface 30 of the tubular section 22 is in full contact with the outer surface of the cylinder 10. Maximum surface-to-surface contact is required as the heat generated by the resistive device 16 is transferred to the heat dissipating device 10 via conduction. Given these limitations, the heat dissipating device 10 can be constructed of many strong, durable materials, such as aluminum or stainless steel. In the preferred embodiment of the invention, heat dissipating device 10 is composed of aluminum and is made using an extrusion process. The material selected for the heat dissipating device 10 can be anodized to protect it from oxidation and to provide a commercially advantageous color.

Those skilled in the art will appreciate that the cooling surface area of the cylinder 20 alone is defined by the equation: the circumference of the cylinder 20 times the length of the cylinder 20. The cooling surface area of the heat dissipating device 10 is defined by the sum of (1) the circumference of the tubular body section 22 times the length of the tubular section 22, and (2) two times the height of the cooling fins 14 times the length of the tubular section 22 times the number of fins. In the preferred embodiment of the invention, the additional surface area provided by the cooling fins 14 amounts to more than two hundred (200) square inches. This represents an increase of three hundred fifty (350) percent in the area of the cooling surface over that of the cylinder 20 alone. This increased cooling surface area permits the heat dissipating device 10 to cool the working fluid within the cylinder 20 with greater efficiency so as maintain it at a more constant viscosity and insure the production of a constant resistive force by the resistive device 16 throughout operation.

Referring now to FIG. 1, once the hydraulic resistive apparatus 8 is assembled by sliding the heat dissipating device 10 onto the cylinder 20 of the resistive device 16, it can be mounted in the exercise device 40.

The exercise device 40 includes a base frame 42 formed from two parallel base supports 44 and 46 connected by a beam 48. A first upright 50 extends substantially perpendicular from the base support 46. A second upright 52 extends from the beam 48 at a position about three-quarters along the length of beam 48 from where it connects to the base support 46. The second upright 52 is tilted toward, and connects to the free end of, the first upright 50. An exercise computer 54 is affixed to the free end of the second upright 52 and provides information regarding the level of exercise being conducted by the user of the exercise device 40. A U-shaped side rail 56 provides support for the operator of the exercise device 40, and has opposing ends connected to the base support 44 as well as being connected to the second upright 52. Padding 58, composed of a suitable non-slip material such as rubber, is positioned along the middle portion of the rail 56. Left and right legs 62 and 64, respectively, are rotatably mounted on first upright 50 using a fastener 60, e.g., a pin or bolt. Legs 62 and 64 have a substantially rectangular configuration. To prevent lateral movement of the legs 62 and 64 along the length of the fastener 60, and to insure that the legs 62 and 64 remain substantially parallel to each other, a spacer 65 is placed on the fastener between the adjacent surfaces of the legs 62 and 64 and the second upright 52. Adjustment slots 66, which each receive a cylinder connection element 68 described in further detail below, are cut out of the legs 62 and 64 and run about two thirds of the length of the legs 62 and 64 as measured from that end connected to the first upright 50. A foot pad 70, composed of a non-slip material such as rubber, is positioned on the upper surface of the free end of legs 62 and 64. The ends of a flexible cable 72, which passes over a pulley (not shown) that is housed within in a protective shroud 74, are connected the legs 62 and 64, respectively.

The cylinder 20 of each of the resistive devices 16 is connected to each of the legs 62 and 64. The free end of each piston 18 is connected to the second upright 52. More particularly, each cylinder 20 has a cylinder connection element 68 mounted on its lower end that connects the cylinder 20 to leg 62 or 64 as appropriate. Each cylinder connection element 68 is U-shaped and has an aperture 76 drilled out of each of its upright portions. The apertures 76 receive a bolt 78 that connects the cylinder 20 to the element 68. A flange 79 extends within the adjustment slot 66 from the underside of the base of the element 68. A locking knob 81 for fixing the position of the element 68 along adjustment slot 66 is positioned on the end of flange 79. Once attached to the legs 62 and 64, the position of the elements 68 can be altered by sliding them along the adjustment slots 66. Movement of the connecting elements 68 toward the foot pads 70 increases the force required to move the legs 62 and 64 while movement away from the foot pads 70 decreases the force required to move the legs 62 and 64.

A bolt 80 fastens the pistons 18 to the second upright 52. More particularly, the bolt 80 passes through both the second upright 52 and an annular flange 82 affixed to the end of each piston shaft 84 extending out of cylinders 20. To prevent lateral movement of the annular flange 82 along the length of the bolt 80, and to insure that the resistive devices 16 remain substantially parallel to each other, a spacer 86 is placed on the bolt 80 between the annular flanges 82 and the surface of the second upright 52 adjacent thereto.

The connections of the piston 18 and cylinder 20 can be reversed. More particularly, the piston 18 of each of the resistive devices 16 can be connected to each of the legs 62 and 64 and the free end of each cylinder 18 connected to the second upright 52. When assembled in this manner, connecting elements 68 are used to join the piston 18 to the legs 62 and 64 and bolt 80 connects the cylinder 20 to the second upright 52.

In operation, the user of the exercise apparatus 40, for example, an exerciser that simulates stair climbing, first sets the position of the cylinder connection elements 68 at the desired position along the adjustment slots 66. Next, the user places his or her feet on the foot pads 70 and begins to push either leg 62 or 64 downwardly. When leg 64 is moved downwardly, cable 72 pulls leg 64 upwardly. Conversely, when leg 64 is moved downwardly, leg 62 is moved upwardly by the cable 72. This up and down pumping causes the cylinder 20 and piston 18 to move relative to each other with the length of the stoke of the piston 18 relative to the cylinder 20 being determined by position of the cylinder connection element 68 along the adjustment slot 66. As the movement of the piston 18 and cylinder 20 continues, friction between the components of these parts, compression of the working fluid, and the flow of the working fluid in the cylinder 20 generates heat. This heat is communicated to the heat dissipating device 10 via conduction and then radiated into the surrounding environment via cooling fins 14. Conduction of the heat generated to dissipating device 10, followed by radiation from the enlarged surface area thereof, efficiently cools the resistive devices 16 so as to maintain the working fluid in them within a selected temperature range to maintain the working fluid at a substantially constant viscosity. Maintenance of the working fluid at a substantially constant viscosity results in the production of a substantially constant resistive force by the resistive devices 16. Since efficient cooling requires maximum conduction of the heat from cylinders 20 to the heat dissipating device 10, maximum surface-to-surface contact between the cylinder 20 and heat dissipating device 10 is required.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by letters patent is:

1. An exercise apparatus for performing a variety of exercises, said apparatus comprising:

(a) a hydraulic resistive device, said hydraulic resistive device providing a hydraulic resistive force for the exercise apparatus, said device including a cylinder and a piston, said piston constrained for reciprocal movement in said cylinder, a working fluid contained in said cylinder, said working fluid within said cylinder providing a resistive force when said cylinder and said piston are moved relative to one another during operation of the exercise apparatus, heat being generated when said hydraulic resistive device is operated; and (b) a heat dissipating device securely engaged to an outer surface of said cylinder, said heat dissipating device including an axially extending, substantially cylindrical tubular sleeve, said sleeve having a body section, an inner diameter of said body section sized such that substantially all of an inner surface of said body section is in surface-to-surface contact with the cylinder of the hydraulic resistive device, and a plurality of fins extending radially from an outer surface of said body section;

(c) said heat dissipating device dissipating heat generated by the relative movement of said piston and said cylinder during operation of said hydraulic resistive device of said exercise apparatus to maintain said working fluid within a selected viscosity range.

2. The hydraulic resistive apparatus of claim 1 wherein said fins of said heat dissipating device extend axially along substantially the entire length of said body section.

3. The hydraulic resistive apparatus of claim 1 wherein said body section has an inner diameter substantially identical to an outer diameter of said cylinder such that the inner surface of said body section will securely engage said outer surface of said cylinder, said body section in surface-to-surface contact with said cylinder.

4. The hydraulic resistive device of claim 3 wherein said body section of said heat dissipating device includes a slit that extends along the length of said body section and substantially parallel to a longitudinal axis of said body section, said slit permitting temporary enlargement of said inner diameter of said body section to permit said heat dissipating device to be slid onto said cylinder, when released said inner surface of said body section is substantially in full surface-to-surface contact with said outer surface of said cylinder.

5. The hydraulic resistive apparatus of claim 1 wherein said heat dissipating device is composed of a flexible, heat-conductive material, said material being flexible enough to permit flexing of said heat dissipating device when said heat dissipating device is slipped onto said cylinder and rigid enough to provide substantially full surface-to-surface contact between said outer surface of said cylinder and an inner surface of said body section and to prevent unwanted movement of said heat dissipating device relative to said cylinder.

6. An improved exercise apparatus of the type utilizing an hydraulic resistive device to provide a hydraulic resistive force, the hydraulic resistive device including a cylinder and a piston, the piston being constrained for reciprocal movement in the cylinder, a working fluid contained in the cylinder, the working fluid within the cylinder providing a resistive force when the piston and the cylinder are moved relative to one another during operation of the exercise apparatus, heat being generated by the movement of the working fluid within the cylinder when the cylinder and piston are moved relative to each other, said improvement comprising:

a heat dissipating device for dissipating the heat generated by the movement of the piston in the cylinder of the hydraulic resistive device during operation of the exercise apparatus, said heat dissipating device securely engaged to an outer surface of the cylinder, said heat dissipating device including an axially extending, substantially cylindrical tubular sleeve, said sleeve having a body section, an inner diameter of said body section sized such that substantially all of an inner surface of said body section is in surface-to-surface contact with the cylinder of the hydraulic resistive device, and a plurality of fins extending radially from an outer surface of said body section.

7. The exercise apparatus of claim 6 wherein said fins of said heat dissipating device extend axially along substantially the entire length of said body section.

8. The exercise apparatus of claim 6 wherein said body section has an inner diameter substantially identical to an outer diameter of the cylinder such that said body section will securely engage said outer surface of the cylinder.

9. The exercise apparatus of claim 8 wherein said body section of said heat dissipating device includes a slit that extends along the length of said body section and substantially parallel to a longitudinal axis of said body section, said slit permitting temporary enlargement of said inner diameter of said body section to permit said heat dissipating device to be slid onto the cylinder, when released said inner surface of said body section is substantially in full surface-to-surface contact with the outer surface of the cylinder.

10. The exercise apparatus of claim 6 wherein said heat dissipating device is composed of a flexible, heat-conductive material, said material being flexible enough to permit flexing of said heat dissipating device when said heat dissipating device is slipped onto the cylinder and rigid enough to provide substantially full surface-to-surface contact between the outer surface of the cylinder and an inner surface of said body section and to prevent unwanted movement of said heat dissipating device relative to the cylinder.

11. A heat dissipating device for a hydraulic resistive device mounted on an exercise apparatus, said hydraulic resistive device having a cylinder and a piston, the piston being constrained for reciprocal movement in the cylinder, a working fluid in the cylinder, said heat dissipating device comprising:

(a) substantially tubular sleeve, said sleeve having a body section, an inner diameter of said body section sized such that substantially all of an inner surface of said body section contacts the hydraulic resistive apparatus so that said body is in surface-to-surface contact with the cylinder of the hydraulic resistive device; and (b) a plurality of cooling fins radially extending from said body for dissipating heat generated by the hydraulic resistive apparatus.

12. The exercise apparatus of claim 11 wherein said cooling fins of said heat dissipating device extend axially along substantially the entire length of said substantially tubular body.

13. The exercise apparatus of claim 11 wherein said substantially tubular body has an inner diameter substantially identical to an outer diameter of the cylinder such that said body will securely engage an outer surface of the cylinder.

14. The exercise apparatus of claim 13 wherein said substantially tubular body of said heat dissipating device includes a slit that extends along the length of said body and substantially parallel to a longitudinal axis of said body, said slit permitting temporary enlargement of said inner diameter of said body to permit said heat dissipating device to be slid onto the cylinder, when released, an inner surface of said body is substantially in full surface-to-surface contact with the outer surface of the cylinder.

15. The exercise apparatus of claim 11 wherein said heat dissipating device is composed of a flexible, heat-conductive material, said material being flexible enough to permit flexing of said heat dissipating device when said heat dissipating device is slipped onto the cylinder and rigid enough to provide substantially full surface-to-surface contact between an outer surface of the cylinder and an inner surface of said body and to prevent unwanted movement of said heat dissipating device relative to the cylinder.

* * * * *